US010975818B2

(12) United States Patent
Romita et al.

(10) Patent No.: US 10,975,818 B2
(45) Date of Patent: Apr. 13, 2021

(54) PUMP UNIT FOR FEEDING FUEL TO AN INTERNAL COMBUSTION ENGINE

(71) Applicant: Robert Bosch GmbH, Stuttgart (DE)

(72) Inventors: Cristina Romita, Bari (IT); Angela Mastai, Bari (IT); Antonio Diaferia, Bari (IT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/614,503

(22) PCT Filed: May 15, 2018

(86) PCT No.: PCT/EP2018/062450
§ 371 (c)(1),
(2) Date: Nov. 18, 2019

(87) PCT Pub. No.: WO2018/210787
PCT Pub. Date: Nov. 22, 2018

(65) Prior Publication Data

US 2020/0200134 A1 Jun. 25, 2020

(30) Foreign Application Priority Data

May 18, 2017 (IT) ..... 102017000054112

(51) Int. Cl.
*F02M 59/44* (2006.01)
*F02M 59/10* (2006.01)
(Continued)

(52) U.S. Cl.
CPC ..... *F02M 59/442* (2013.01); *F02M 59/102* (2013.01); *F02M 63/0001* (2013.01);
(Continued)

(58) Field of Classification Search
CPC .... F02M 59/44; F02M 59/442; F02M 63/001; F02M 2200/9038; F02M 2200/8069; F02M 2200/9061; F04B 53/143; F04B 53/18
See application file for complete search history.

(56) References Cited

U.S. PATENT DOCUMENTS 6,477,940 B1 11/2002 Danckert et al.
10,288,023 B2 * 5/2019 Loiacono ..... F04B 1/0452
(Continued)

FOREIGN PATENT DOCUMENTS

DE 10259955 7/2004
DE 10350275 6/2005
(Continued)

OTHER PUBLICATIONS

International Search Report for Application No. PCT/EP2018/062450 dated Jun. 13, 2018 (3 pages).

*Primary Examiner* — Hieu T Vo
(74) *Attorney, Agent, or Firm* — Michael Best & Friedrich LLP

(57) ABSTRACT

A pump unit for feeding fuel, in particular diesel fuel, to an internal-combustion engine; the pump unit comprising a head (2) inside which a cylinder (3) is formed along an axis; a pumping piston (4) housed inside the cylinder and comprising a head portion (24) inside the cylinder and an opposite foot portion (23) projecting outside the cylinder; wherein the piston is slidable inside the cylinder in a reciprocating manner between a first position and a second position where the foot projects from the cylinder by a greater or smaller amount respectively; and wherein the outer surface of the piston comprises a portion (16) with a surface finish so as to have less friction and a greater lubricant-retaining capacity than the remainder of the outer surface of the piston; the portion extending along the axis
(Continued)

between the head of the piston and a first intermediate point (17) in the first position of the piston, the first intermediate point being inside the cylinder.

14 Claims, 2 Drawing Sheets

(51) Int. Cl.
*F02M 63/00* (2006.01)
*F04B 53/14* (2006.01)
*F04B 53/18* (2006.01)

(52) U.S. Cl.
CPC ..... *F04B 53/143* (2013.01); *F04B 53/18* (2013.01); *F02M 2200/8069* (2013.01); *F02M 2200/9038* (2013.01); *F02M 2200/9061* (2013.01)

(56) References Cited

U.S. PATENT DOCUMENTS

| | | | | |
|---|---|---|---|---|
| 2005/0063835 | A1 | 3/2005 | Buettner et al. | |
| 2020/0208597 | A1 * | 7/2020 | Corizzo ..... | F02M 59/48 |

FOREIGN PATENT DOCUMENTS

| | | | |
|---|---|---|---|
| DE | 102005061781 | | 6/2007 |
| EP | 2320063 | A2 | 5/2011 |
| WO | 2015004189 | | 1/2015 |
| WO | 2015110242 | | 7/2015 |

* cited by examiner

PUMP UNIT FOR FEEDING FUEL TO AN INTERNAL COMBUSTION ENGINE

The present invention relates to a pump unit for feeding fuel, preferably diesel fuel, to an internal combustion engine.

As is known, a pump unit for feeding fuel, preferably diesel fuel, to an internal combustion engine comprises a head which has, formed therein, at least one cylinder housing the associated sliding pumping piston. One end of the pumping piston, in particular the inner end with respect to the pump unit, which projects from the cylinder and is called the piston foot, is connected to an actuator, usually a cam shaft, which performs the movement of the piston. A special spring is provided for keeping the piston foot pressed against the associated actuator. Moving along the reciprocating cylinder, the piston performs an intake stroke, during which it draws fuel into the cylinder, and a compression stroke during which it compresses the fuel retained inside the cylinder. The cylinder portion where compression is performed is called the compression chamber and the other end of the piston, called piston head, is housed inside this chamber. Generally, the feeding into cylinder occurs through a hole, or intake hole, while discharging of the compressed fuel occurs along a transverse hole or delivery hole. The external part of the head for collecting the fuel, which must be fed into the chamber, is called the intake chamber which is closed externally by a special lid, or closure, which is sealingly fastened against the head. An intake valve and a delivery valve for regulating the correct flow of the fuel respectively from the intake chamber to the compression chamber and from the compression chamber to the engine are provided. Outside the head, the delivery valve is connected to the engine, preferably by means of a common header provided with a plurality of injectors.

The intake chamber is in communication with an intake duct for feeding the fuel drawn from the storage tank by means of a low-pressure pump, usually a gear pump. The pump unit also comprises filtering systems, for example ring filters at the inlet of the intake chamber, for protecting the components of the high-pressure pump from the impurities present in the fuel fed by the low-pressure pump.

Lubrication of the sliding piston inside the cylinder is ensured by means of the fuel itself which seeps between the piston and the cylinder from the compression chamber to the base of the cylinder, beyond which the piston foot interacts with the cam shaft. Since this cam shaft is lubricated by an oil bath, it is nowadays necessary to provide the base of the cylinder with a seal able to prevent contact between the underlying oil and the fuel which has seeped in and accumulated at the base of the cylinder.

Moreover, this fuel which has seeped in and accumulated at the base of the cylinder must be periodically removed from the cylinder because its high temperature could damage the seal situated precisely at the base of the cylinder.

According to the prior art the seeped fuel which has accumulated at the base of the cylinder is again fed to the intake chamber. For this purpose a special channel, which connects the intake chamber to a chamber for storing the fuel at the base of the cylinder in the region of the seal, is formed in the cylinder head.

In order to prevent the risk of the piston becoming jammed inside the cylinder nowadays it is known to coat the piston with a layer of DLC (diamond like carbon).

In the light of this prior art, today there exists the need to provide an alternative solution which is able to prevent jamming of the piston inside the cylinder as well as prevent the infiltration of oil from the outside to the inside of the cylinder containing the fuel which is periodically transferred back to the intake chamber.

According to the present invention a pump unit for feeding fuel, in particular diesel fuel, to an internal combustion engine is provided. This pump unit comprises:

- a head inside which a cylinder extending along an axis A is formed;
- a pumping piston housed inside the cylinder and comprising a head portion inside the cylinder and an opposite foot portion projecting outside the cylinder. As is known, the head of the piston is located in the region of the compression chamber and is fed by an intake valve which is in turn connected to an intake chamber. Again in a known manner, the foot of the piston is kept pressed against a cam shaft lubricated by an oil bath. During rotation of the cam shaft the piston slides inside the cylinder in a reciprocating manner between a first and a second position where the foot projects by a greater or smaller amount from the cylinder. These movements of the piston are referred to as "intake stroke", which terminates with the foot of the piston in a position fully extracted from the cylinder, and "compression stroke", which terminates with the foot of the piston in a position fully retracted towards the cylinder.

According to a first aspect of the invention the outer surface of the piston comprises a first surface-machined portion, namely with a first surface finish, so as to produce less friction with the cylinder and have a greater capacity for retaining lubricant, i.e. in the case in question part of the fuel which has seeped between piston and cylinder. These properties are to be regarded as being in relation to the remainder of the outer surface of the piston, but also the first portion itself prior to the surface treatment. The first portion extends along the axis A from substantially the head of the piston as far as a first intermediate point. This first intermediate point is situated always, i.e. even when the piston is fully extracted, inside the cylinder.

Advantageously this solution improves the mechanical interaction between piston and cylinder precisely in the zone of contact where jamming may occur.

Preferably, following surface-machining, the first portion comprises a plurality of cavities in the form of micro dimples arranged in a matrix. According to an example of embodiment, these cavities may be formed by means of laser surface-machining and may have a diminishing progression, namely decreasing intensity, from the piston head towards the first intermediate point. Preferably the interaxial distance between the cavities is about 100-250 μm. while the diameter and depth of each cavity is respectively about 30-150 μm and about 2-10 μm.

According to another aspect of the invention, which may complement or represent an alternative to the preceding aspect, the outer surface of the piston comprises a second surface-machined portion, namely with a second surface finish, so as to have a smaller lubricant-retaining capacity, namely so as to be substantially oil-repellent. Such properties are to be regarded as being in relation to the remainder of the outer surface of the piston, but also in relation to the second portion itself prior to the surface treatment. The second portion extends along the axis A between the foot of the piston and a second intermediate point. This second intermediate point is situated always, i.e. even when the piston is fully extracted, inside the cylinder.

Advantageously, therefore, the transportation of the cam shaft lubrication oil towards the inside of the cylinder where it could be mixed with the seeped fuel is prevented.

Preferably, following the surface machining, the second portion comprises the deposition of a coating layer which is configured to make the surface oil-repellent, and/or the formation in this second portion of superficial nanostructures also configured to reduce the oil droplet retention capacity. According to an example of implementation, these superficial nanostructures are formed by means of plasma or laser surface-machining. By way of example, the oil-repellent surface coating has a thickness of between 400 and 900 nm, while the nanostructures have a height of a few tens of nanometres.

According to two preferred alternative embodiments of the invention, the second intermediate point coincides with the first intermediate point, in other words a third portion of the piston without surface-machining is present between the first and second portions.

The first of the aforementioned two embodiments of the invention is functional for pumps not provided with particular seals at the inner end of the cylinder.

The second embodiment is instead able to cooperate with the aforementioned seal so that, when the piston is fully extracted, the second intermediate point is situated opposite the seal, whereas, when the piston is fully retracted, the second intermediate point is situated inside the cylinder beyond the seal.

Further characteristic features and advantages of the present invention will become clear from the description below of a non-limiting example of embodiment thereof, with reference to the figures of the attached drawings, in which.

Figure 1:
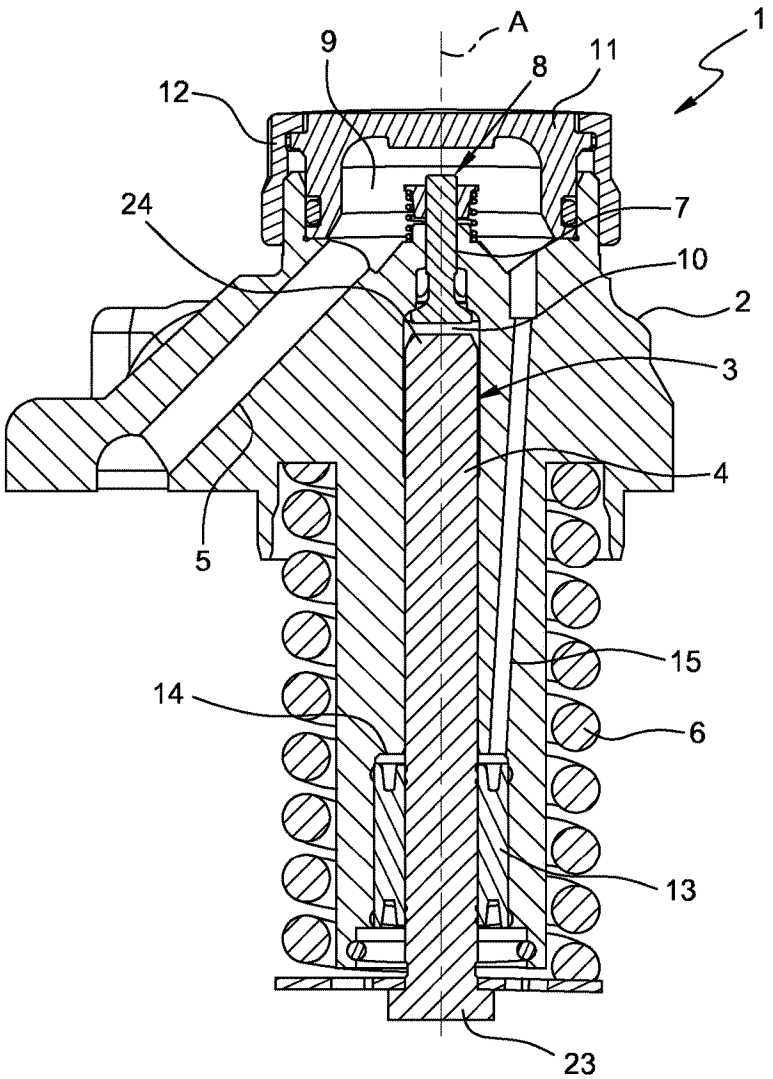
FIG. 1 is a schematic cross-sectional view of a portion of a pump unit for feeding fuel to an internal combustion engine.

With reference to the list of figures indicated above FIG. 1 is a schematic cross-sectional view of a constructional example of a pump unit for feeding fuel to an internal combustion engine. According to this example, the pump unit 1 comprises a head 2 inside which a cylinder 3 with an axis A for housing a sliding pumping piston 4 is formed. The head 2 also has, formed inside it, an intake duct 5 for feeding the fuel from a storage tank outside the pump to the cylinder 3 and a delivery duct 2 (visible in FIG. 2) for discharging the fuel compressed by the cylinder 3.

An actuator device (not shown), for example a cam shaft, for performing the reciprocating movement of the piston inside the cylinder 3 is provided at the inner end or foot of the piston 23. For this purpose the foot of the piston 23 projects outside the cylinder 3 and is pressed by means of a spring 6 against the cam shaft. The cam shaft is lubricated by an oil bath. At the opposite end, or head of the piston 24, the cylinder 3 is provided with a hole 7, arranged axially along the axis A, for housing an intake valve 8 which places the compression chamber 10 of the cylinder 3 in communication with an intake chamber 9 situated outside the head 2 and fed with the fuel via the intake duct 5. The intake valve 8 comprises a stem-type closing member which straddles the hole 7 and on one side projects into the compression chamber 10 and on the other side projects into the intake chamber 9. On the outside of the head 2, the intake chamber 9 is closed by a lid 11 pressed against the head 2 by a locking ring 12. Both the sealed connection of the lid 11 with the head 2 and the connection between the locking ring 2 and the lid 11 are known.

The pump unit 1 comprises a seal 13 at the inner end of the cylinder 3. This seal 13 has the purpose of stopping the downward flow of the fuel which has seeped between cylinder 3 and piston 4 and therefore defines inside the head 2 a storage chamber 14 for the seeping fuel. This seal 13 prevents moreover the return flow inside the cylinder 3 of the oil for lubrication of the cam shaft in contact with the foot of the piston 23. Preferably this storage chamber 14 has an annular form about the axis A.

As can be seen in FIG. 1, an internal discharge channel 15 is formed inside the head 2 and extends from the storage chamber 14 to the intake chamber 9.

Figure 2:
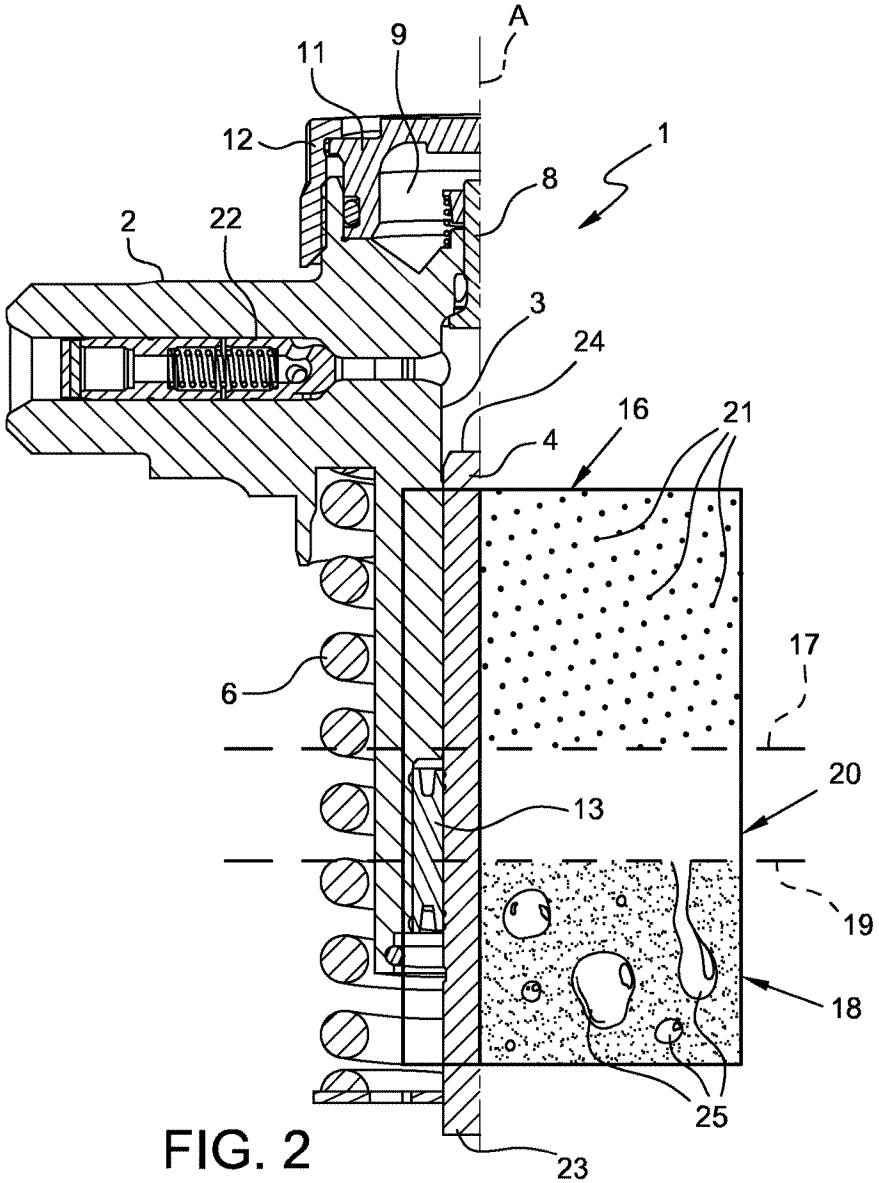
FIG. 2 is a view of a portion of the pump unit according to FIG. 1, which schematically shows various zones of the piston, provided with different surface-machined finishes, according to the present invention.

FIG. 2 is a view of a portion of the pump unit according to FIG. 1, which schematically shows various zones of the piston, with different surface-machined finishes, according to an example of the present invention. Starting from the head 24 and moving downwards along the axis A towards the foot 23, the piston 4 has three portions arranged in series with different surface properties. In particular two of the three portions have different surface-machined finishes, while the third surface is simply a surface, which has not been further treated, according to the prior art. The first portion 16 extends substantially from the head 24 of the piston 4 as far as a first intermediate point 17. As schematically shown in FIG. 2, in this first portion 16, the side surface of the piston 4 comprises a plurality of cavities 21 in the form of micro fissures or depressions arranged ordered in an matrix and having a diminishing extension from the head 24 of the piston 4 towards the first intermediate point 17. A third portion 20, without surface-machining, is provided in series with the first portion 16. A second portion 18 is provided in series with the third portion 20 and terminates at the foot 23 of the piston. As schematically shown in FIG. 2, in this second portion 18 the side surface of the piston 4 comprises a coating layer provided in the form of superficial nanostructures. In FIG. 2 oil droplets are schematically indicated by the reference number 25; these droplets, since they are no longer able to adhere to the piston, fall by means of gravity towards the foot of the piston.

Figure 3:
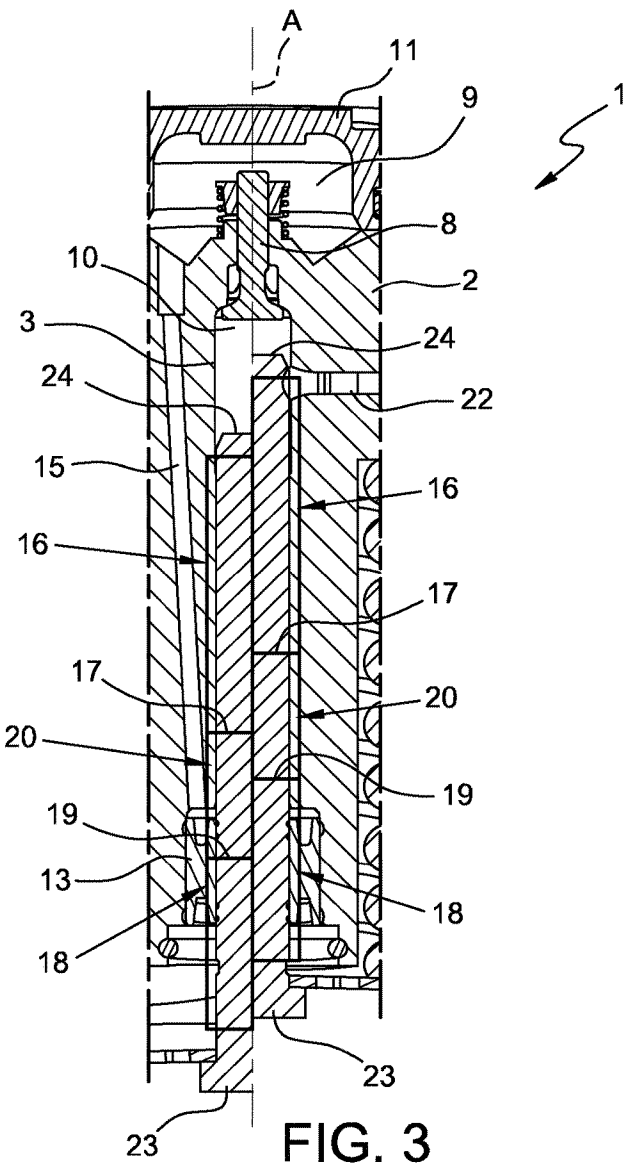

FIG. 3 shows in schematic form the piston 4, according to FIG. 2, fully extracted (left-hand side) and minimally extracted (right-hand side) from the cylinder 3. As can be seen in this example, the first intermediate point 17 connecting together the first portion 16 and third portion 20 is always situated inside the cylinder 3 and is never situated facing the seal 13 present at the end of the said cylinder 3. In this embodiment, the second intermediate point 19, which connects the third portion 20 to the second portion 18, is situated opposite the seal 13 in the position where the piston 4 is fully extracted and, inside the cylinder 3 beyond the seal 13, in the fully retracted position of the piston 4.

Figure 4:
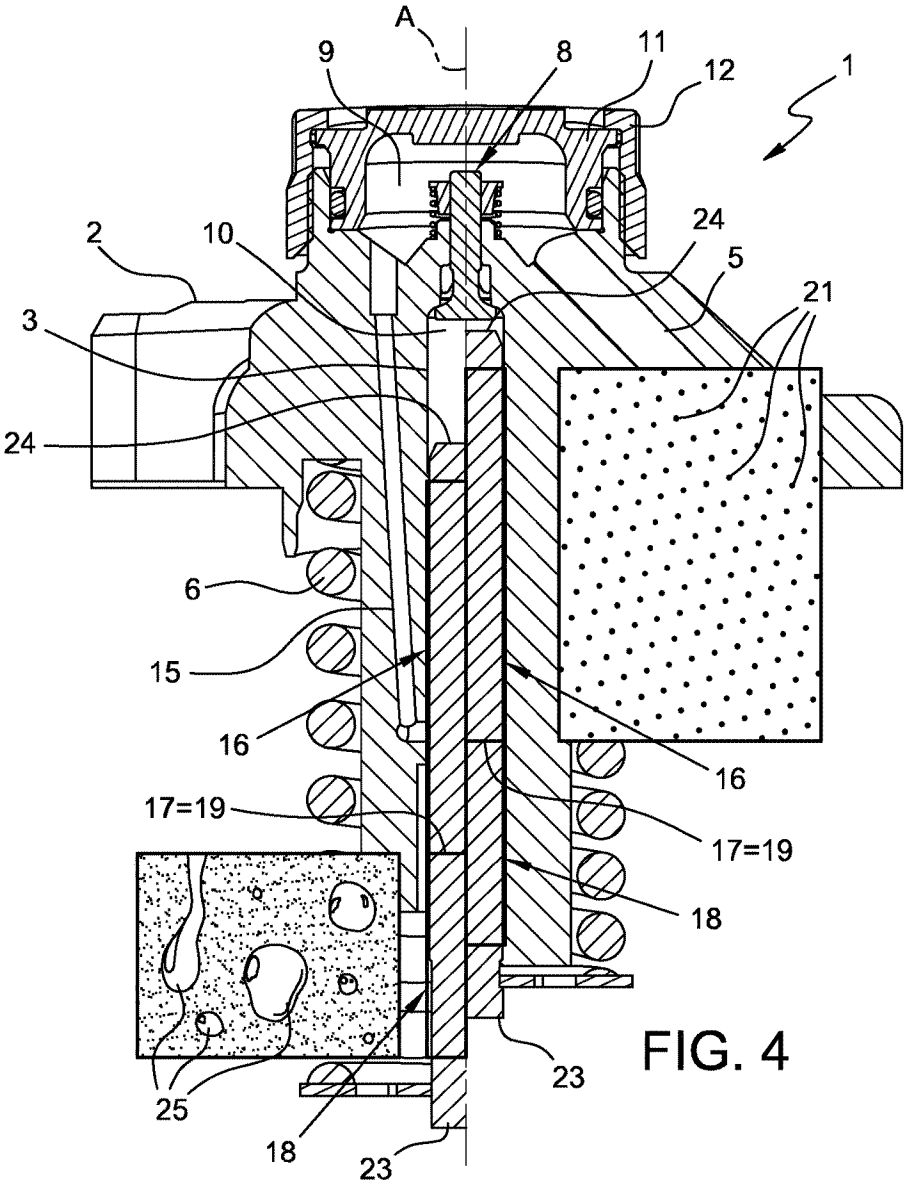
FIGS. 3 and 4 show schematic cross-sectional views of two different embodiments of the invention in different operating positions.

FIG. 4 shows an alternative embodiment of the invention in which the seal 13 is not present and the piston 4 is not provided with the third portion 20. In this example, therefore, the first intermediate point 17 and the second intermediate point 19 coincide.

It is clear that the present invention described here may be subject to modifications and variations without departing from the scope of protection of the accompanying claims.

The invention claimed is:

1. A pump unit for feeding fuel to an internal combustion engine, the pump unit (1) comprising:

a head (2) inside which a cylinder (3) extending along an axis (A) is formed; and a pumping piston (4) housed inside the cylinder (3) and comprising a head portion (24) inside the cylinder and an opposite foot portion (23) projecting outside of the cylinder (3), the piston (4) being slidable inside the cylinder (3) in a reciprocating manner between a first position and a second position where the foot (23) projects from the cylinder (3) by a greater or smaller amount, respectively;

wherein an outer surface of the piston (4) comprises a first portion (16) with a first surface finish having less friction and a greater lubricant-retaining capacity than the remainder of the outer surface of the piston (4); the first portion (16) extending along the axis (A) between the head portion (24) of the piston (4) and a first intermediate point (17) in the first position of the piston (4), the first intermediate point (17) being inside the cylinder (3), wherein the outer surface of the piston (4) comprises a second portion (18) with a second surface finish having smaller lubricant-retaining capacity than the same portion before machining; the second portion (18) extending along the axis (A) between the foot (23) of the piston (4) and a second intermediate point (19) in the first position of the piston (4), the second intermediate point (19) being inside the cylinder (3), and wherein the second portion (18) comprises a coating layer provided in the form of superficial nanostructures.

2. The pump unit as claimed in claim 1, wherein the cavities (21) are formed by laser surface-machining.

3. The pump unit as claimed in claim 1, wherein the cavities (21) of the first portion have a diminishing extension from the head portion (24) of the piston (4) towards the first intermediate point (17).

4. The pump unit as claimed in claim 1, wherein the superficial nanostructures are formed by plasma surface-machining.

5. The pump unit as claimed in claim 1, wherein the second intermediate point (19) coincides with the first intermediate point (17).

6. The pump unit as claimed in claim 1, wherein a third portion (20) of the piston, which has not been surface-machined, is present between the first portion (16) and the second portion (18).

7. The pump unit as claimed in claim 6, wherein the pump unit (1) comprises a seal (13) at an end of the cylinder (3) engaged with the foot (23) of the piston (4); in the first position of the piston (4) the second intermediate point (19) being opposite the seal (13), while in the second position of the piston (4) the second intermediate point is inside the cylinder (3) beyond the seal (13).

8. A pump unit for feeding fuel to an internal combustion engine, the pump unit (1) comprising:

a head (2) inside which a cylinder (3) extending along an axis (A) is formed; and a pumping piston (4) housed inside the cylinder (3) and comprising a head portion (24) inside the cylinder and an opposite foot portion (23) projecting outside of the cylinder (3), the piston (4) being slidable inside the cylinder (3) in a reciprocating manner between a first position and a second position where the foot (23) projects from the cylinder (3) by a greater or smaller amount, respectively;

wherein an outer surface of the piston (4) comprises a first portion (16) with a first surface finish having less friction and a greater lubricant-retaining capacity than the remainder of the outer surface of the piston (4); the first portion (16) extending along the axis (A) between the head portion (24) of the piston (4) and a first intermediate point (17) in the first position of the piston (4), the first intermediate point (17) being inside the cylinder (3), wherein the first portion (16) comprises a plurality of cavities (21) in the form of micro dimples arranged in a matrix, wherein the outer surface of the piston (4) comprises a second portion (18) with a second surface finish having smaller lubricant-retaining capacity than the same portion before machining; the second portion (18) extending along the axis (A) between the foot (23) of the piston (4) and a second intermediate point (19) in the first position of the piston (4), the second intermediate point (19) being inside the cylinder (3), and wherein the second portion (18) comprises a coating layer provided in the form of superficial nanostructures.

9. The pump unit as claimed in claim 8, wherein the cavities (21) are formed by laser surface-machining.

10. The pump unit as claimed in claim 8, wherein the cavities (21) of the first portion have a diminishing extension from the head portion (24) of the piston (4) towards the first intermediate point (17).

11. The pump unit as claimed in claim 8, wherein the superficial nanostructures are formed by plasma surface-machining.

12. The pump unit as claimed in claim 8, wherein the second intermediate point (19) coincides with the first intermediate point (17).

13. The pump unit as claimed in claim 8, wherein a third portion (20) of the piston, which has not been surface-machined, is present between the first portion (16) and the second portion (18).

14. The pump unit as claimed in claim 13, wherein the pump unit (1) comprises a seal (13) at an end of the cylinder (3) engaged with the foot (23) of the piston (4); in the first position of the piston (4) the second intermediate point (19) being opposite the seal (13), while in the second position of the piston (4) the second intermediate point is inside the cylinder (3) beyond the seal (13).

* * * * *